US007537465B2

(12) United States Patent
Fang et al.

(10) Patent No.: US 7,537,465 B2
(45) Date of Patent: May 26, 2009

(54) ELECTRICAL CONNECTOR WITH IMPROVED POSITIONING DEVICE

(75) Inventors: Zhi-Hong Fang, Kunshan (CN); Yu-Hua Mao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/011,069

(22) Filed: Jan. 23, 2008

(65) Prior Publication Data

US 2008/0176455 A1 Jul. 24, 2008

(30) Foreign Application Priority Data

Jan. 23, 2007 (CN) ..... 2007 2 0034034

(51) Int. Cl.
*H01R 12/00* (2006.01)

(52) U.S. Cl. ..... 439/79; 439/247; 439/701

(58) Field of Classification Search ..... 439/79, 439/247, 701
See application file for complete search history.

(56) References Cited

U.S. PATENT DOCUMENTS

| | | | | |
|---|---|---|---|---|
| 4,857,017 | A * | 8/1989 | Erk | 439/695 |
| 5,249,974 | A * | 10/1993 | Wang | 439/79 |
| 5,692,912 | A | 12/1997 | Nelson et al. | |
| 5,947,769 | A | 9/1999 | Leonard et al. | |
| 5,957,705 | A | 9/1999 | David et al. | |
| 6,554,653 | B2 * | 4/2003 | Henneberger | 439/676 |

* cited by examiner

*Primary Examiner*—Truc T Nguyen
(74) *Attorney, Agent, or Firm*—Wei Te Chung

(57) ABSTRACT

An electrical connector (100) includes an insulating housing (1) defining a front end portion and a rear end portion. At least one row of terminals (2) are retained in the housing (1) with tail portions (22) extending out of the rear end portion of the housing. A positioning device includes a first member integrally defined from the rear end portion of the housing and a second member (3) separately from the housing (1). The tail portions (22) of the terminals (2) are firstly pre-positioned by the first member and then positioned by the second member (3) of the positioning device when the second member is assembled on the housing.

17 Claims, 6 Drawing Sheets

ELECTRICAL CONNECTOR WITH IMPROVED POSITIONING DEVICE

BACKGROUND OF THE INVENTION

1. Field of the Invention

The present invention relates to an electrical connector having a positioning device.

2. Description of Related Art

High density electrical connectors are widely used in more and more electrical products due to rapid development of electronic industry. The connector generally comprises a plurality of terminals mounted on a housing and a positioning device to ensure that the plurality of terminals are accurately soldered to appointed pads or traces of a printed circuit board (PCB).

U.S. Pat. Nos. 5,692,912, 5,947,769, 5,957,705 respectively discloses an electrical connector with such a positioning device. The positioning device is a plate like and defines four rows of through holes arranged at predetermined intervals. A plurality of terminals has tails extending out of the housing and bending downwardly. The positioning device is assembled onto the insulating housing along a bottom-to-top direction and the terminal tails are inserted into corresponding through-holes of the positioning device. However, the through-holes of the positioning device are not easy to aim at the tails especially the tails are curving or slant. Hence, a new design which can solve the problem is required.

SUMMARY OF THE INVENTION

An object of the present invention is to provide an electrical connector with an improved positioning device, which is easily assembled.

In order to achieve above-mentioned objects, an electrical connector comprises: an insulating housing defining a front end portion and a rear end portion; at least one row of terminals retained in the housing with tail portions extending out of the rear end portion of the housing; a positioning device comprising a first member integrally defined from the rear end portion of the housing and a second member separately from the housing; wherein the tail portions of the terminals are firstly pre-positioned by the first member and then positioned by the second member of the positioning device when the second member is assembled on the housing.

Other objects, advantages and novel features of the present invention will become more apparent from the following detailed description of the present embodiment when taken in conjunction with the accompanying drawings.

DETAILED DESCRIPTION OF THE INVENTION

Figure 1:
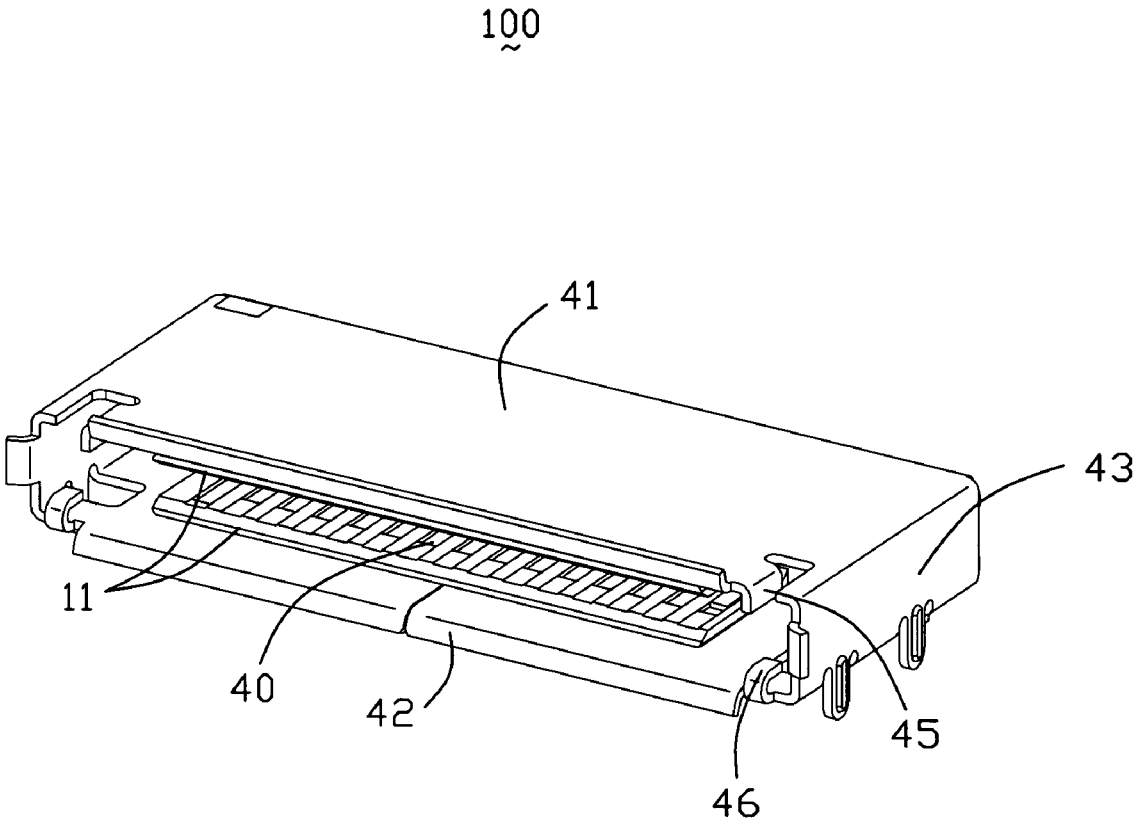
FIG. 1 is an assembled perspective view of an electrical connector in accordance with the present invention.

Reference will now be made to the drawing figures to describe a preferred embodiment of the present invention in detail.

Figure 2:
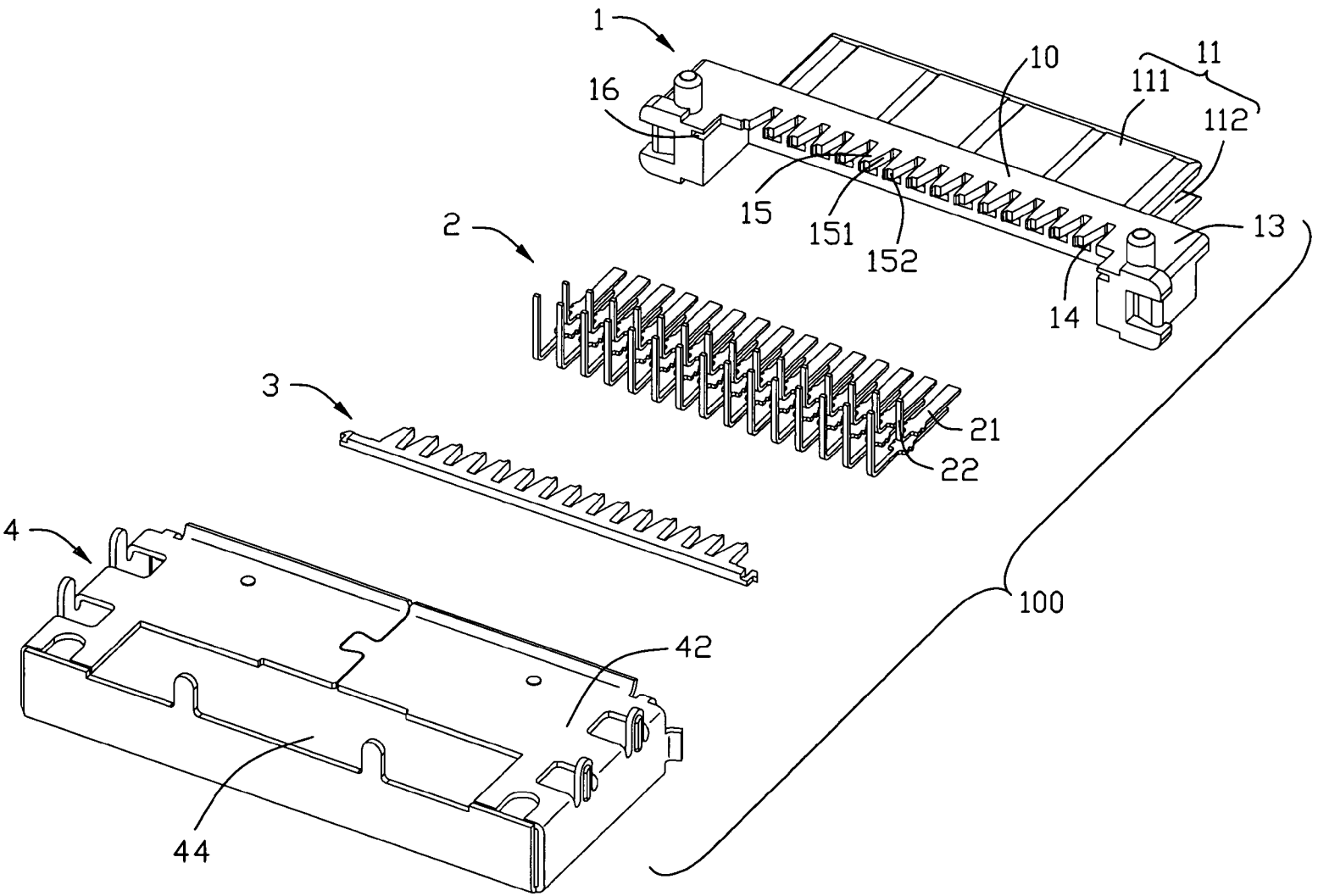
FIG. 2 is an exploded perspective view of the electrical connector shown in FIG. 1.

Referring to FIG. 2, an electrical connector 100 comprises an insulating housing 1, two rows of conductive terminals 2, a positioning device and a shell 4 assembled to the insulating housing 1. The positioning device comprises a first member extending integrally from the housing 1 and a second member 3 provided separately from the housing 1 and cooperating with the first member.

The insulating housing 1 includes a base portion 10 and a mating portion 11. The base portion 10 has a front end portion and a rear end portion. The mating portion 11 extends from the front end portion of the base portion 10. The mating portion 11 includes an upper tongue plate 111 and a lower tongue plate 112 parallel to the upper tongue plate 111. A plurality of terminal passageways 14 is defined on a lower surface of the upper tongue plate 111 and an upper surface of the lower tongue plate 112, which is running through the rear end of the base portion 10 along a front-to-rear direction. The passageways 14 of the upper row and lower row are arranged offset and alternatively. A pair of assembled portions 13 extend rearward respective from opposite ends of the base portion 10 and a receiving space is defined between the pair of assembled portions 13 to accommodate the conductive terminals 2. A plurality of first wedge portions 15 is arranged in a row along a longitudinal direction of the housing and extending rearward from a bottom rear edge of the base portion 10 to the receiving space. A V-shaped first interval portion 151 is defined between every adjacent wedge portions 15. A first opening portion 152 is defined by cutting out a small piece of the front end of the wedge portion 15. An elongated slot 16 is defined at an inner side of each protrusion portion 13. The slots 16 run through the rear wall of the assembled portions 13. The first member of the positioning device is provided with the first wedge portions 15 and the first interval portions 151 between the wedge portions.

Figure 3:
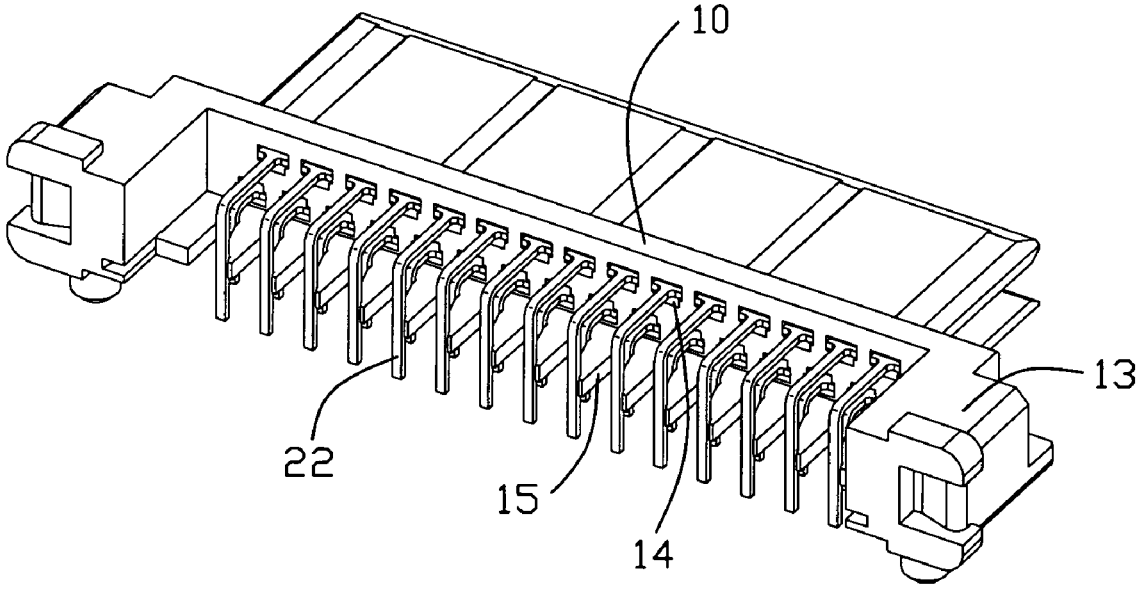
FIG. 3 is an assembled perspective view of the housing shown in FIG. 1, wherein the terminals are pre-positioned in a first member of a positioning device.

Referring to FIGS. 2 and 3, the conductive terminals 2 are arranged in two rows and the terminals are respectively received in the two rows of passageway 14. Front engaging portions 21 of the terminals 2 are received in the passageways of the mating portion and the terminals further extend rearward out of the main portion of the housing. A tail portion 22 of the terminal 2 further extends downwardly. The tail portions 22 of upper row extend rearwardly further so that the tail portions of the upper and lower rows are staggered in front-to-rear direction. The tail portions of the upper row are pre-positioned in roots of the first opening portions 152 and the tail portions of the lower are pre-positioned in the first interval portions 151.

Figure 4:
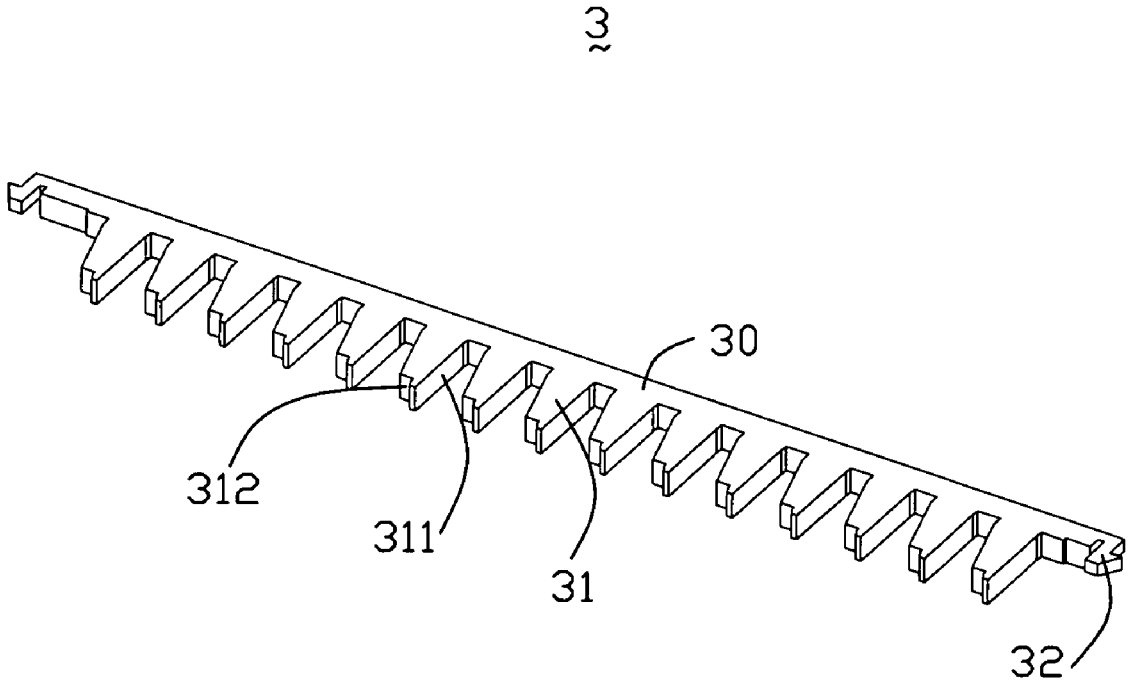
FIG. 4 is a perspective view of a second member of the positioning device shown in FIG. 1.
Figure 5:
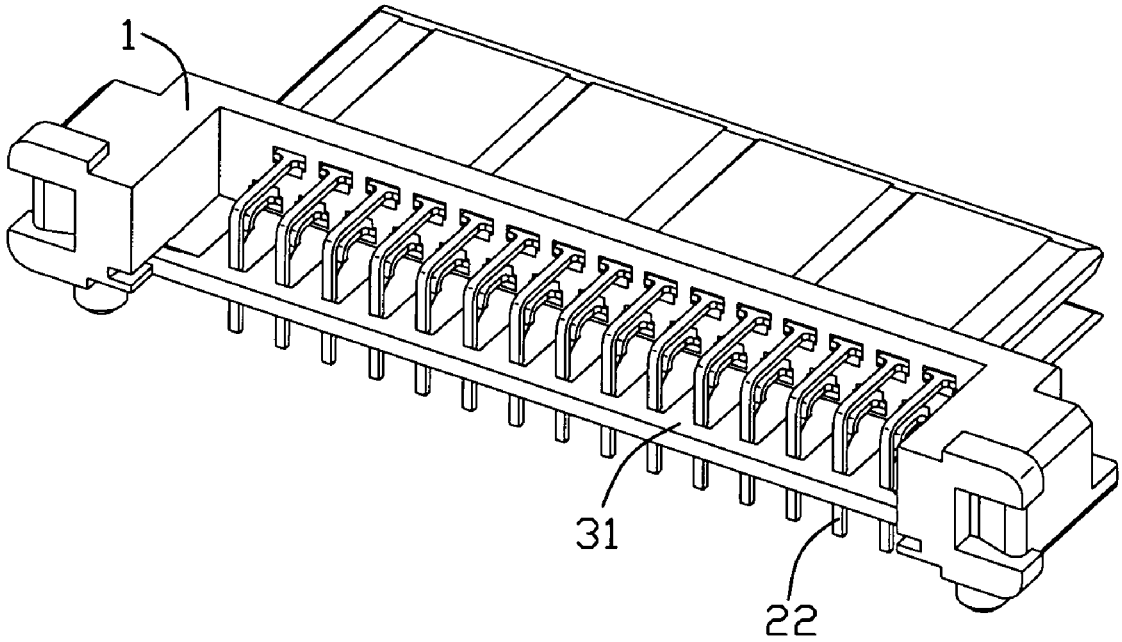
FIG. 5 is an assembled perspective view of the housing shown in FIG. 1, wherein the second member of the positioning device is assembled onto the housing.

Combined with FIGS. 4 and 5, the second member 3 of the positioning device comprises an elongated base portion 30 and a plurality of second wedge portions 31 arranged at predetermined intervals and extending forward from the base portion 30. A V-shaped second interval portion 311 is defined between every adjacent wedge portions 31. A second opening portion 312 is defined at each distal end of the wedge portion 31. A pair of locking portions 32 is respectively formed at opposite ends of the body portion 30 to fix the second member 3 of the positioning device onto the insulating housing 1.

After the conductive terminals 2 are assembled into the housing 1 and the tail portions 22 of the terminals 2 have reached the predetermined position, the second member 3 of the positioning device is assembled onto the housing 1 along the rear-to-front direction. The locking portions 32 are inserted into the slots 16 at both inner sides of the protrusion portions 13 until they lock with the inners of the slots 16. The second wedge portions 31 are inserted into the first interval portions 151, the second interval portions 311 are fulfilled with the tail portions 22 of the upper row which are received in the first opening portions 152 to maintain the tail portions in the determined position. The second opening portions 312 accommodate with the tail portions 22 of the lower row which are received in the first interval portions 151. As described above, the first member and the second member of the positioning device cooperate with each other to maintain each tail portions 22 of the conductive terminals 2 in the determined position and prevent them from slanting.

Figure 6:
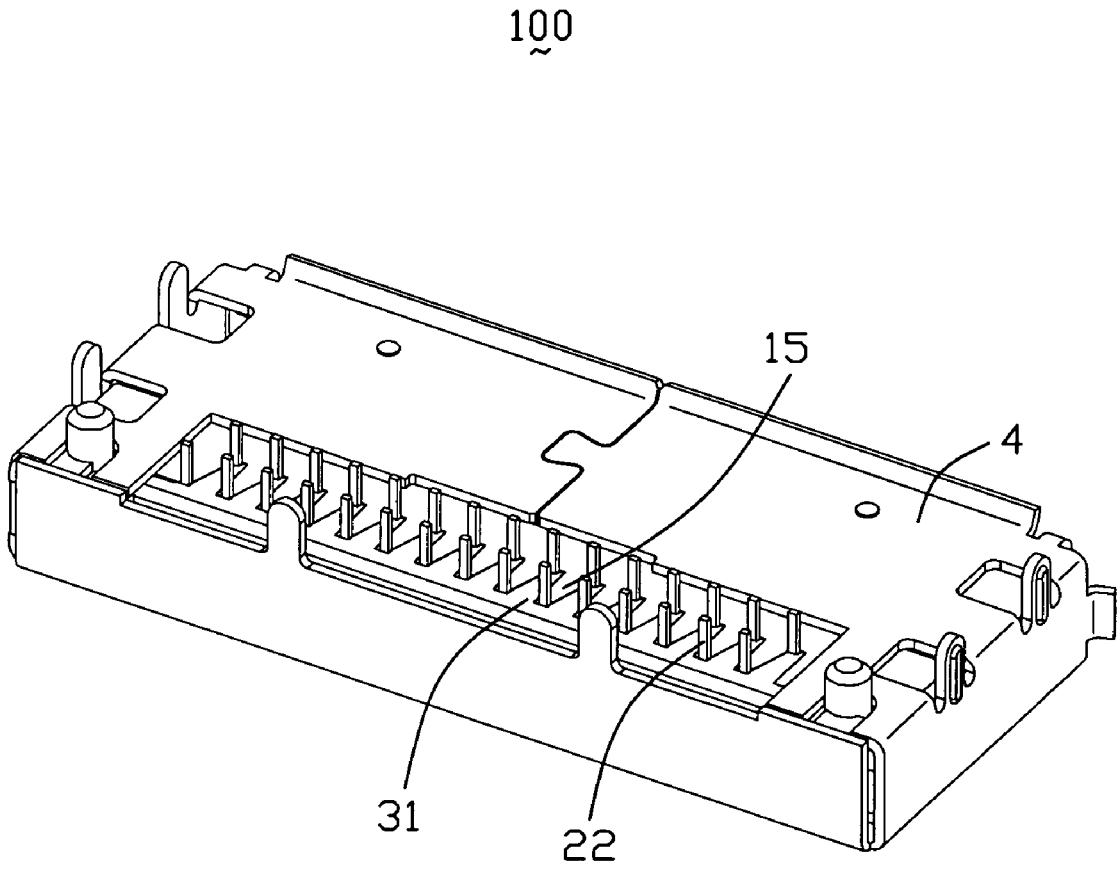
FIG. 6 is an assembled perspective view of the electrical connector shown in FIG. 1 from another direction.

Referring to FIGS. 1 and 2, the electrical connector further comprises a shell 4 assembled around the housing 1. The shell 4 comprises a top wall 41 and a bottom wall 42 and sidewalls 43 interconnecting the top wall 41 and bottom wall 42 thereby forming a frame encapsulating the housing 1. A pair of tabs 45 is respectively formed by bending a cutout portion (not figured) downwardly from both sides of a front end of the top wall 41 and in parallel to the sidewalls 43. A pair of anti-disorientation arrangements 46 is arranged on both sides of a front end of the bottom wall 42 and in parallel to the top wall 41. The tab 45 and the anti-disorientation arrangement 46 can prevent a mating connector (not shown) from mispluging. Furthermore, an opening 44 is formed in the bottom wall 42 to allow the tail portions 22 of the terminals 2 to go through, as best seen in FIG. 6.

In the present invention, the terminal tails 22 of the terminals 2 are firstly pre-positioned by the first member of the positioning device, and then being pressed and retained by the second member 3 of the positioning device, which will debase orderliness requirement of the tail portions of terminals. More, the V-shaped interval portions 151 and 311 convince the insertion of the second member to the first member. Furthermore, the front end of the first and second members are helpful to position the tail portions in the predetermined position.

The present invention is not limited to the electrical connector mentioned above. This disclosure is illustrative only, changes may be made in detail, especially in matter of shapes, size, and arrangement of parts within the principles of the invention. For example, the electrical connector can arrange three or more rows of terminals, the positioning device only need to define another opening portion to pre-position the tail portions. More, the second member 3 of the positioning device can interfere with the inner side of the protrusion portion 13 by the opposite ends of the base portion 30, therefore the locking portions 32 can be omitted.

What is claimed is:

1. An electrical connector comprising:

an insulating housing defining a front end portion and a rear end portion;

at least one row of terminals retained in the housing with tail portions extending out of the rear end portion of the housing;

a positioning device comprising a first member integrally defined from the rear end portion of the housing and a second member separately from the housing;

wherein the tail portions of the terminals are firstly pre-positioned by the first member and then positioned by the second member of the positioning device when the second member is assembled on the housing, and the first and second members cooperatively hold a same portion of each tail portion therebetween;

wherein a pair of assembled portions are respectively formed at opposite ends of the housing and accommodating the first member of the positioning device therein;

wherein a slot is defined in an inner side of each assembled portion, the second member defines a pair of locking portions at opposite ends thereof, the locking portions are inserted into the slots and locking with the slots.

2. The electrical connector as described in claim 1, wherein the first member comprises a plurality of first wedge portions arranged at a predetermined interval, and the second member comprises a plurality of second wedge portions corresponding and cooperating with the first wedge portions.

3. The electrical connector as described in claim 2, wherein a first and a second interval portions are respectively defined between adjacent wedge portions of the first member and second member, a plurality of tail portions of the terminals are pre-positioned in the first interval portions.

4. The electrical connector as described in claim 1, wherein a shell is provided to be assembled on the housing, the shell defines an opening at its bottom wall to allow the tail portions of the terminals to go through.

5. The electrical connector as described in claim 3, wherein an opening portion is defined on the first wedge portion, a plurality of tail portions of the terminals are pre-positioned in the opening portions of the first member.

6. The electrical connector as described in claim 3, wherein at least an opening portion is defined on the first wedge portion, a plurality of tail portions of the terminals are retained between the opening portions and the second interval portions, and a plurality of tail portions of terminals are retained between the first interval portions and the second wedge portions.

7. The electrical connector as described in claim 5, wherein a plurality of terminals are arranged in an upper row and a lower row, the tail portions of the upper row are received in the opening portions of the first wedge portion.

8. An electrical connector comprising:

an insulating housing defining a front end portion and a rear end portion;

a plurality of terminals mounting on the housing with tail portions extending out of the housing;

a positioning device comprising a first member integrally extending from a rear end portion of the housing and a second member separately from the housing;

wherein the second member is assembled on the housing along a rear-to-front direction and interpositioned in the first member at a same level to retain the tail portions of the terminals;

wherein a pair of assembled portions are respectively formed at opposite ends of the housing and accommodating the first member of the positioning device therein;

wherein a slot is defined in an inner side of each assembled portion, the second member defines a pair of locking portions at opposite ends thereof, the locking portions are inserted into the slots and locking with the slots.

9. The electrical connector as described in claim 8, wherein a pair of slots are respectively defined on the assembled portions for receiving the locking portions formed at opposite ends of the second member.

10. The electrical connector as described in claim 8, wherein said first member and said second member are located at a same level to efficiently retain the corresponding tail portions therebetween in said rear-to-front direction.

11. The electrical connector as described in claim 8, wherein a pair of assembled portions respectively protrude from opposite ends of the rear end portion of the housing, the first and second members are located between the assembled portions.

12. The electrical connector as described in claim 9, wherein the first member and second member respectively have wedge portions and interval portions to insert into or accommodate corresponding interval portions and wedge portion on opposing member.

13. An electrical connector comprising:

an insulative housing;

a metallic shell enclosing the housing;

a plurality of contacts disposed in the housing, each of said contacts defining a downwardly extending tail;

a positioning device including a front part unitarily extending from a rear face of the housing, and a rear part being discrete from the front part and assembled to at least one of said housing and said shell;

said tail defines a four-sides cross-section, of which two adjacent sides confronting the front part while the other two adjacent sides confronting the rear part;

wherein the front part defines a plurality of rearward protrusions forming a plurality of front and rear rearward vertical engagement faces alternately with each other, and the rear part defines a plurality of forward protrusions forming a plurality of front and rear forward vertical engagement faces alternately with each other under a condition that said front part and said rear part are essentially coplanar with each other, the front rearward engagement face confronts the front forward engagement face, and the rear rearward engagement face confronts the rear forward face.

14. The electrical connector as claimed in claim 13, wherein said front part defines an L-shaped engagement face to confront the corresponding two adjacent sides of the four-sided cross-sectional of the tail.

15. The electrical connector as claimed in claim 13, wherein said rear part defines an L-shaped engagement face to confront the corresponding other two adjacent sides of the four-sided cross-sectional of the tail.

16. The electrical connector as claimed claim 13, wherein said front part defines a first L-shaped engagement face to confront the corresponding two adjacent sides of the four-sided cross-sectional of the tail, and said rear part defines a second L-shaped engagement face to confront the corresponding other two adjacent sides of the four-sided cross-sectional of the tail.

17. The electrical connector as claimed in claim 13, wherein the front part defines a plurality of rearward wedged protrusions and the rear part defines a plurality of forward wedged protrusions alternately interengaged with each other in a compliance manner at a same level.

* * * * *